US006655043B1

(12) United States Patent
Kingery

(10) Patent No.: US 6,655,043 B1
(45) Date of Patent: Dec. 2, 2003

(54) DRYER MOISTURE INDICATOR

(75) Inventor: Ernest Roy Kingery, Hulbert, OK (US)

(73) Assignee: APAC Inc., Atlanta, GA (US)

( * ) Notice: Subject to any disclaimer, the term of this patent is extended or adjusted under 35 U.S.C. 154(b) by 0 days.

(21) Appl. No.: 09/957,255

(22) Filed: Sep. 21, 2001

(51) Int. Cl.[7] ..... F26B 7/00

(52) U.S. Cl. ..... 34/364; 34/475; 34/483; 34/491

(58) Field of Search ..... 34/359, 360, 363, 34/364, 365, 368, 402, 443, 467, 474, 475, 476, 486, 491, 492, 493, 483

(56) References Cited

U.S. PATENT DOCUMENTS 3,672,070 A * 6/1972 Stacy et al. ..... 34/485
3,699,665 A * 10/1972 Shinskey ..... 34/549
3,765,612 A * 10/1973 Wenger ..... 241/23
3,801,264 A * 4/1974 Lindl ..... 432/37
4,179,265 A * 12/1979 Gildersleeve ..... 432/36
4,267,643 A * 5/1981 Haried ..... 34/553
4,354,317 A * 10/1982 Mathis et al. ..... 34/499
4,413,426 A * 11/1983 Graff ..... 34/473
4,470,878 A * 9/1984 Petrovic et al. ..... 201/39
4,492,040 A * 1/1985 Jensen et al. ..... 34/367
4,509,272 A * 4/1985 Gräff ..... 34/473
4,704,805 A * 11/1987 Kaya et al. ..... 34/483
4,888,885 A * 12/1989 Caughey ..... 34/503
6,079,121 A * 6/2000 Khadkikar et al. ..... 34/528
6,199,294 B1 * 3/2001 Becker ..... 34/80
6,383,553 B1 * 5/2002 Tondar et al. ..... 427/8

* cited by examiner

*Primary Examiner*—Ira S. Lazarus
*Assistant Examiner*—Andrea M. Ragonese
(74) *Attorney, Agent, or Firm*—Frank J. Kowalski

(57) ABSTRACT

A moisture indicator in an air flow drying process where hot gas is circulated over and around a granular material having an undesirable amount of moisture includes a detector located in the path of the exhaust gas to determine exhaust flow temperature, a valve control device associated with the temperature detector to control the percentage of hydrocarbon gas in the hot gas intake and an indicator connected to the valve control device. A display is associated with the indicator to display the percentage of hydrocarbon gas in the gas intake which indicates the amount of moisture in the granular material. The percentage of hydrocarbon gas needed in the intake is inversely proportional to the amount of moisture in the granular material. The percentage signals the loader operator whether the granular material loaded has an acceptable amount of moisture for successful operation of the drying process.

6 Claims, 2 Drawing Sheets

DRYER MOISTURE INDICATOR

BACKGROUND OF THE INVENTION

1. Field of the Invention

The present invention pertains to indicators and more particularly to indicators that display the condition of the contents of containers where knowledge of the condition of the contents of the container is necessary for the performance of supporting activities.

2. Related Prior Art

In the area of material drying, such as sand drying, the relative moisture content of material to be dried must be known. The relative moisture content is often critical to the speed with which a subsequent dependent process may be accomplished. In some processes, such as drying sand, a high moisture content may prevent the drying process from being accomplished or completed efficiently or satisfactorily.

For example, in a sand drying plant where the sand is to be added to aggregates and oil derivatives to form asphalt, the moisture content of sand must be decreased to a predetermined level. Sand is scooped up from an outdoor pile and placed in a large tumbler. The sand is put through a drying procedure where hot gas is circulated over the wet sand, run through a dryer transition stage to a dust collector and then exhausted through the use of a large exhaust fan. The temperature of the exhaust is low when moisture is present in the sand and increases as the moisture content decreases or the sand is dried. When more sand having a significant moisture content is placed in the drying area, the temperature of the exhaust gas drops again, depending on the amount of moisture in the sand.

Although all the sand is taken from the same mound, in most cases taking sand from higher on the mound will result in loading sand with a lower moisture content. This is due primarily to the effect of gravity (moisture, i.e. water, is heavier than air and will tend to leach to the lower areas of the mound) and the drying effect of the sun and wind which will be most noticeable on the top and exposed sides of the mound. The drying effect of the sun and wind can be very rapid and significant and can aid in the drying process. In general, dropping the height of the bucket into which sand is loaded by a mere four inches, that is, taking the sand from deeper on the mound where it has a higher moisture content, can produce a significant change in the drying operation. The resulting change can be so significant that it can mean the difference between an efficient successful drying operation and one which operates too slowly and inefficiently, causing costs to increase because of increased man hours and increased gas consumption.

Unfortunately, the person who has the most control over the amount of moisture in the sand being loaded, and as a result, the gas consumption, has the least knowledge of the amount of moisture in that sand and the amount of gas being consumed. The dryer operator located in the control room is the only person who has the information concerning the moisture content through the knowledge of the amount of gas being consumed to dry the sand.

There are many types of moisture indicators in the art. Some detect the amount of moisture contained in a substance directly by insertion of a probe into the material, measure the moisture content and provide a digital readout of the actual moisture content. One such type is the "AQUA-SPEAR" moisture meter manufactured Mastrad Company.

U.S. Pat. No. 4,047,105, titled "Method and Apparatus for Providing an Output Indication Proportional to the Moisture Content of Particulate Material", issued to Bruce Olen Anderson relates to method and apparatus for providing an output indication proportional to the moisture content of particulate material where a probe drive signal having a predetermined frequency and amplitude is inserted and applied to the particulate material. A current indicator signal proportional to the current applied to the particulate material is provided. The current signal is proportional to the moisture content of the particulate material.

U.S. Pat. No. 4,621,229, titled "Instrument for Measuring the Moisture Content of Solids", issued to Friedrich Hirth, relates to an Instrument for measuring the moisture content of solids that has probes which are placed in contact with the material which is to have its moisture content measured. The probes are used to measure the electrical resistance of the material. A d.c. voltage is connected with the probes and generates the voltage required for measurement of electrical resistance. The characteristic line representing the electrical resistance of the material as a function of its moisture content is logarithmic in nature and, in order to generate a straight characteristic line, the signals from the probes are fed to a logarithmic amplifier. The amplified signals are converted to a moisture content which may be read from an indicator constituting part of the instrument. A calibrating unit is interposed between the logarithmic amplifier and the indicator and functions to adjust the characteristic line of the instrument so that this at least approximates the characteristic line of the material undergoing moisture determination.

Other types of moisture indicators may provide a reading by color change. Humidity Indicators manufactured by AGM Container Controls, Inc. are of this type. In general, these indicate the amount of humidity in a specific area. For example, this type of moisture indicator is placed in a closed area such as a room or section of a building. The ambient air humidity is indicated by the color of the indicator. When dealing with a large area such as a room, the color change will be slow to indicate a gradual change in humidity and not an instantaneous change for a small area.

SUMMARY OF THE INVENTION

The present invention provides a moisture indicator in an air flow drying process where hot gas is circulated over and around a granular material. Typically, this granular material has an undesirable amount of moisture content. In this process, the temperature of the gas after it has been circulated over the wet or damp sand provides an indication of the moisture content of the sand. The greater the moisture content in the sand, the cooler the exhaust gas and conversely, the dryer the sand, the hotter the exhaust gas temperature. The moisture indicator of the present invention includes a detector located in the path of the exhaust gas to determine exhaust flow temperature. A detector is placed in the gas flow process after it has been circulated over the sand to detect temperature of the exhaust gas. A valve control device is either electrically or mechanically associated with the temperature detector. This valve control device is used to control the flow percentage of hydrocarbon gas in the hot gas intake. When the temperature of the gas in the exhaust section drops below a predetermined level, a signal is sent to the valves that control the amount of flammable gas (hydrocarbon heating gas) in the intake flow. This signal causes the valves to open, increasing the percentage of heating gas in the gas flow, increasing the temperature of the hot gas intake. An indicator is connected or linked with the valve control device. The indicator is associated with a display showing the percent of hydrocarbon gas that is currently being fed to the hot gas intake in order to maintain a predetermined temperature in the exhaust gas. This in turn provides an indication of the amount of moisture in the granular material that has just been loaded into the moisture dryer. The percentage of hydrocarbon gas in the intake gas flow is directly proportional to the percentage of moisture in the granular material being dried. The indicator is operated in conjunction with the valve control for the intake hydrocarbon gas and is indicative of the amount of moisture in the granular material as a function of the percentage of gas needed to maintain a predetermined temperature in the exhaust gas. This provides a signal to the loader operator as to whether the granular material loaded has an acceptable amount of moisture for successful, efficient operation of the drying process or whether he should take sand or other granular material from another location.

DESCRIPTION OF THE PREFERRED EMBODIMENT

Figure 1:
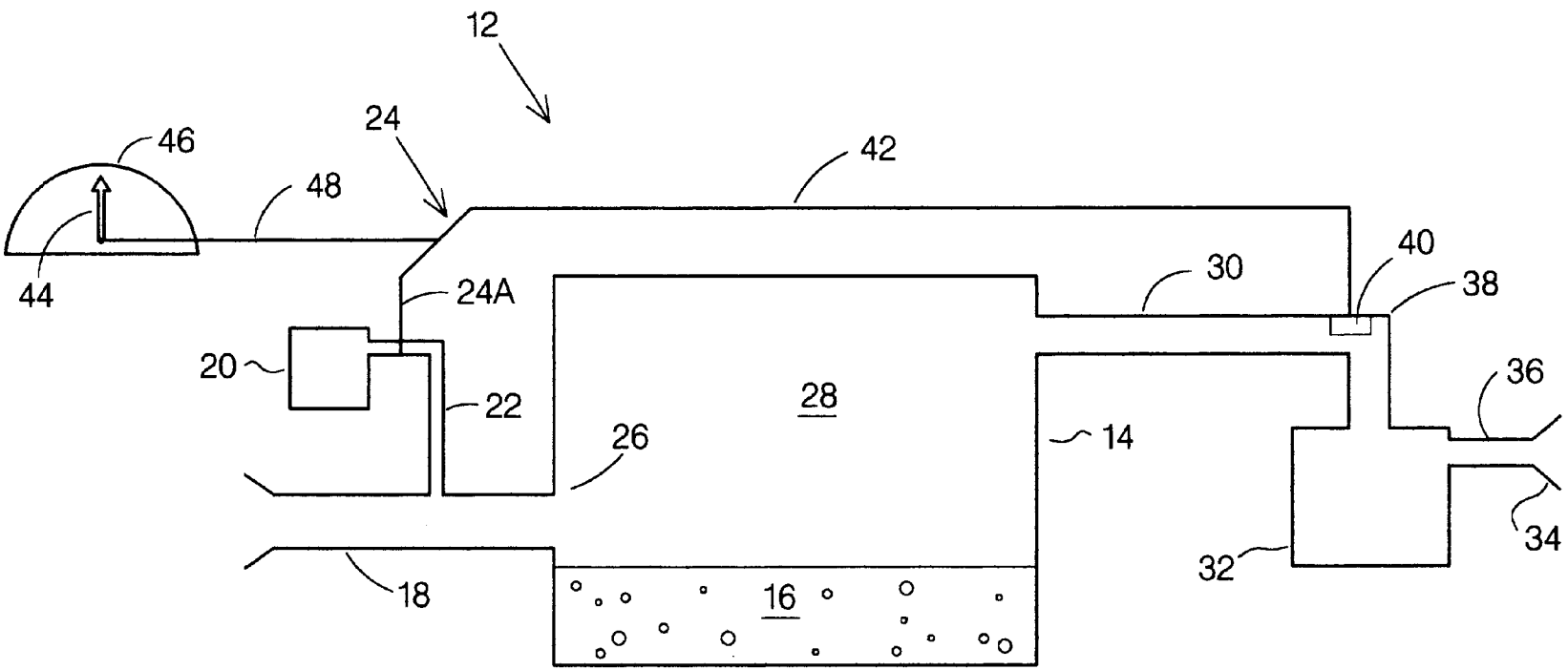
FIG. 1 is a schematic view of a granular material drying operation.

Referring now to FIG. 1, a schematic diagram of a granular material drying operation 12 is illustrated. A container 14 is shown as containing granular material 16 in its lower portion. In this embodiment the granular material used may be sand or other aggregates that require moisture removal. A hot air intake 18 is illustrated as connected to one end of container 14 which provides hot gas for the drying process. A hydrocarbon gas source 20 is connected to hot air intake 18 through a gas line 22.

Intake pipe 18 is preferably approximately thirty inches in diameter with gas line 22 preferably being approximately one inch in diameter. Other sizes may be used as long as it permits adequate intake air flow and proper mixing of hydrocarbon or other flammable gas.

Valve assembly 24 with valves 24A, . . . , etc. is used in gas line 22 to control the amount of hydrocarbon gas which is mixed with outside air within hot gas intake 18. The hot gas mixture enters container 14 at an opening 26, which connects to hot gas intake 18. A hot gas 28 circulates throughout container 14 heating granular material 16 to remove any moisture that it may have. As hot gas 28 contacts moisture laden granular material 16, it provides heat calories to permit moisture to change states from water to water vapor by absorbing heat. The absorption of heat to vaporize the moisture in granular material 16 causes a reduction in the temperature of hot gas 28.

Hot gas 28 is then withdrawn from container 14 through an exhaust pipe 30. Exhaust pipe 30 carries hot air 28 through a dust collector 32. Exhaust pipe 30 is also approximately thirty inches in diameter, but again, any size may be used as long as a proper air flow is permitted. Exhaust pipe 30 has an elbow 38 at point spaced apart from container 14. The purpose of elbow 38 is to change direction of air flow to direct any dust particles into dust collector 32. Temperature detector 40 is located outside of container 14 but before elbow 38 in order to obtain the temperature of hot gas 28 as it comes out of container 14 and before it cools further. Any further cooling of hot gas 28 will provide an erroneous reading and cause too high a percentage of hydrocarbon or flammable gas to be mixed with the intake air.

An exhaust line 34 is connected to dust collector 32 and contains a fan 36 which pulls hot air 28 from dust collector 32. Contained within exhaust pipe 30, near an elbow 38 which turns down to dust collector 32, is a temperature sensor 40.

Exhaust 34 is also preferably a pipe having a thirty inch diameter with fan 36 mounted therein. Fan 36 may be of any type currently in use in the art, as long as it is sized to fit within exhaust 34 and has the drawing ability to pull hot air out of the drying container.

Temperature sensor 40 is used to detect the temperature of hot gas 28 as it is exhausted from container 14. Sensor 40 sends a signal indicative of the temperature of exhaust hot gas 28 through a line 42. Line 42 is connected to a valve assembly 24. Valve assembly 24 is used to control the amount or percentage of hydrocarbon gas being fed to intake line 18. Valve assembly 24 is connected to an indicator 44 mounted on a display 46 through a mechanical linkage 48. Indicator 44 is associated with display 48 which indicates the percentage of hydrocarbon gas being fed through intake 18.

In operation hot air enters container 14 through opening 26. Hot air 28 provides the additional calories to vaporize any moisture which may be contained within granular material 16. The greater the moisture content in granular material 16, the greater the number of calories provided by hot air 28 needed to vaporize the moisture in granular material 16.

When hot air 28 is withdrawn from container 14 to dust collector 32 through the pulling action of fan 36, it passes by temperature detector 40. Temperature detector 40 compares the temperature of the exhaust gas 28 with a predetermined minimum. When the temperature of exhaust gas 28 is below this predetermined minimum, temperature detector 40 sends a signal to valve assembly 24 to open the valves 24A, . . . , etc., allowing a greater percentage of hydrocarbon gas from container 20 to travel through gas line 22 to be mixed with intake air within intake pipe 18. Thus, the lower the temperature of hot gas 28 when it reaches temperature detector 40, the more hydrocarbon gas that gets mixed with ambient air in air intake 18.

When the temperature drops and valve assembly 24 is told to open valves 24A, . . . , etc. to permit more hydrocarbon gas to flow, mechanical linkage 48 moves indicator 44 to the right as valves 24A, . . . , etc. open. Moving indicator 44 to the right indicates a greater percentage of hydrocarbon gas on display 46.

Similarly, if the temperature of hot gas 28 as measured by temperature detector 40 exceeds a predetermined value, a signal is sent through connection 42 to valve assembly 24 to have it close valves 24A, . . . , etc. and reduce the amount of hydrocarbon gas being fed to intake pipe 18. As valve assembly 24 closes valves 24A, . . . , etc., mechanical linkage 48 moves indicator 44 to the left, indicating on display 46 that the intake gas contains a lower percentage of hydrocarbon gas.

Figure 2:
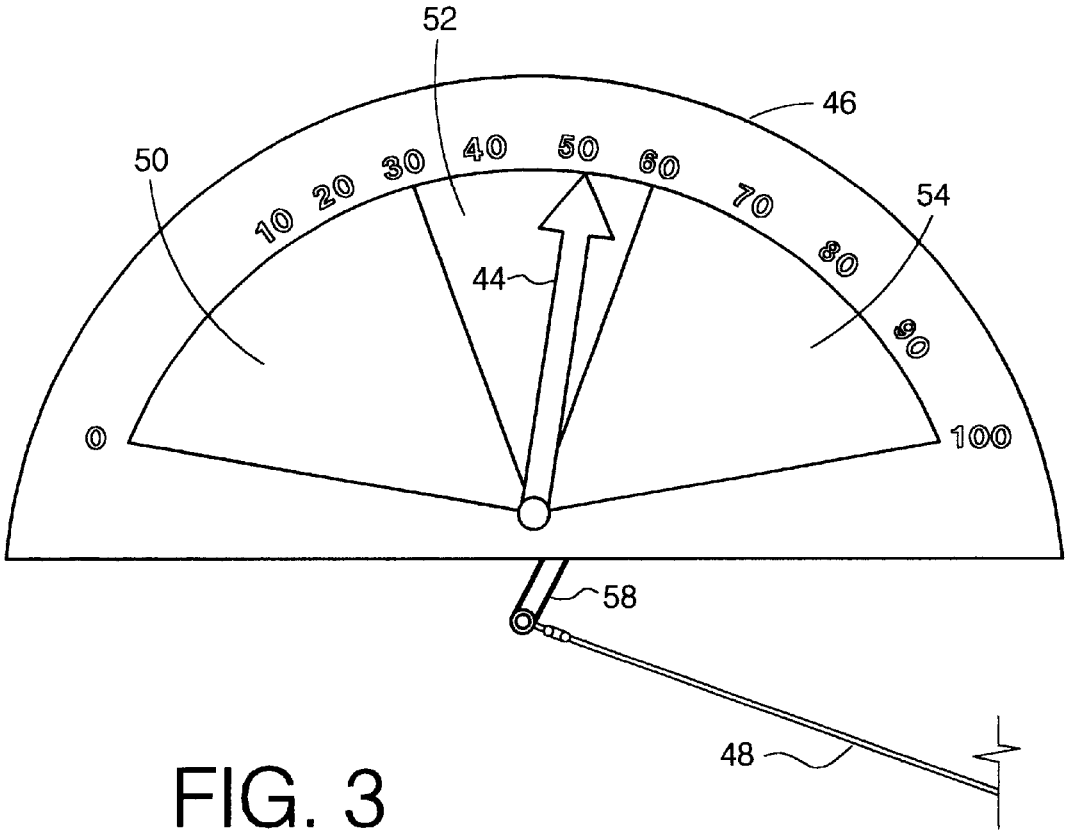
FIG. 2 is a front view of the display illustrated in connection with the granular drying operation of FIG. 1.

Referring to FIG. 2, display 46 is illustrated with indicator 44, showing display 46 as a tractor operator (not shown) would view it from his operating position. As illustrated, display 46 contains a large green area 50, a white area 52 and a large red area 54. When the moisture content of granular material 16 is at an acceptable level, indicator 44 points to or is located in green area 50. As the moisture content increases, indicator 44 will move to through white area 52.

When the moisture content reaches an unacceptable level, indicator 44 points to or is located in the red area 54. Indicator 44 pointing to the red area 54 is a clear indication to the loader operator that the bucket on the tractor is digging too deep into the mound of sand. The loader operator should either raise his bucket or move to a different location on the sand mound or to a different sand mound. The operation of wind and sun on a sand mound can be such that a mere raising of the bucket four inches can bring the moisture content of granular material 16 down to a level that the moisture level is acceptable. This will move indicator 44 from red area 54 to green area 50.

Figure 3:
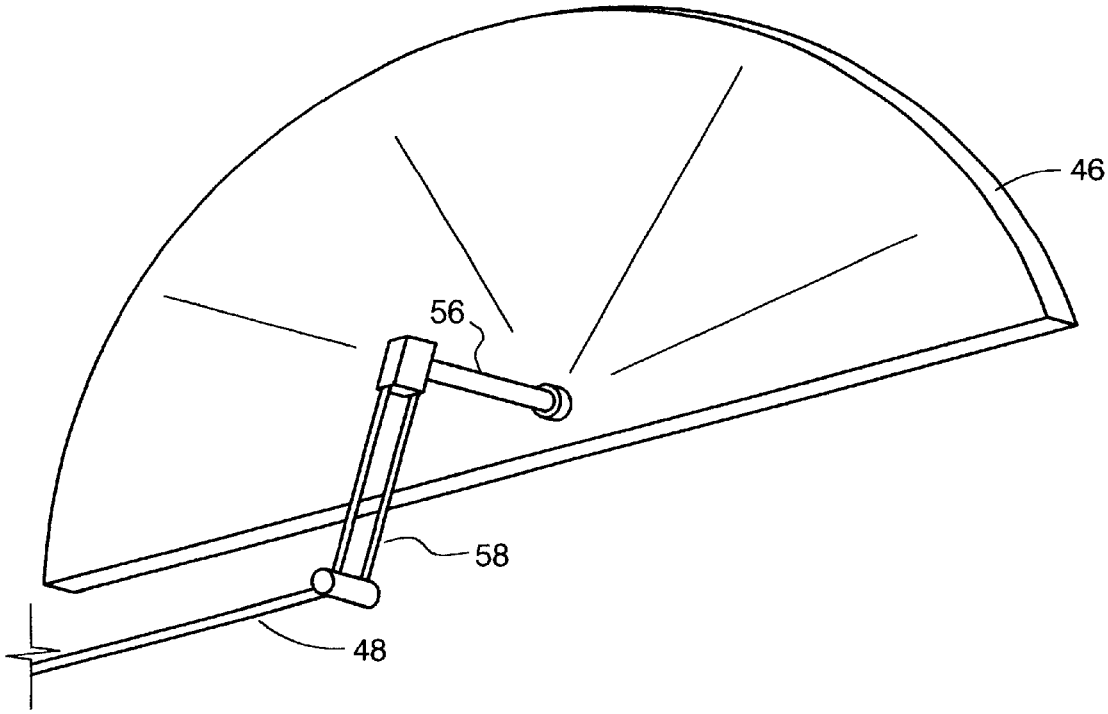
FIG. 3 is a back view of the display of FIG. 2.

Referring now to FIG. 3, a back view of display 46 is illustrated. A base 56 of indicator 44 is illustrated as extending through display 46. Base 56 is fastened to a slip linkage 58. As mechanical linkage 48 moves to the right indicator 44 will move to the left. And conversely, as mechanical linkage 48 moves to the left moving the lower portion of slip linkage 58 to the left, indicator 44 will move to the right.

As can be seen, through the measurement of exhaust hot gas 28 using temperature detector 40, the opening and closing of valves 24A, . . . , etc. of valve assembly 24 can be controlled to regulate the flow of hydrocarbon gas from supply 20 through gas line 22. The opening and closing of valves 24A of valve assembly 24 will move indicator 44 using mechanical linkage 48 through slip linkage 58 and base 56 to indicate the percentage of hydrocarbon gas in intake gas 28 on display 46. This percentage of hydrocarbon gas is the percentage which is needed to maintain the temperature of hot intake gas 28 within a predetermined temperature range. The exhaust temperature of hot gas 28 is inversely proportional to the amount of moisture within granular material 16. As the moisture content of granular material 16 increases, the exhaust temperature of hot gas 28 decreases. Similarly, when the moisture content of granular material 16 decreases, the exhaust of hot gas 28 increases. The inverse proportionality is approximately linear so that an increase in temperature indicates a proportional decrease in moisture and a decrease in the exhaust temperature of hot gas 28 indicates a proportional increase in the moisture content of granular material 16.

While there has been illustrated and described a particular embodiment of the present invention, it will be appreciated that numerous changes and modifications will occur to those skilled in the art, and the present invention should not be limited thereto. It is intended that the present invention cover all those changes and modifications which fall within the true spirit and scope of the appended claims.

What is claimed is:

1. A method of indicating the amount of moisture contained in a granular material in a drying operation having a hot gas intake and a gas exhaust including:

measuring a temperature of gas in said gas exhaust;

controlling the hot gas intake in response to said temperature of gas in said gas exhaust;

associating a visual indicator with said controlling the hot gas intake; and using said indicator with a display to display an indication of moisture amount in the granular material.

2. The method according to claim 1 wherein said controlling includes:

opening valves providing flammable gas to said hot gas intake when said measured temperature is below a predetermined minimum; and closing said valves providing flammable gas to said hot gas intake when a measured temperature from said measuring a temperature exceeds a predetermined maximum.

3. The method according to claim 2 wherein said associating an indicator includes:

connecting said indicator with said valves providing flammable gas to said hot gas intake to provide an indication of moisture content of the granular material.

4. A method of indicating an amount of moisture contained in a granular material in a drying container having a hot gas intake and a gas exhaust including:

measuring a temperature of gas in said gas exhaust;

controlling a temperature of the hot gas intake by controlling a percentage content of flammable gas in the hot gas intake in response to said temperature of gas in said gas exhaust; and using a visual indicator associated with a display to display an indication of said percentage content of flammable gas as a function of the amount of moisture in the granular material.

5. The method according to claim 4 wherein said controlling a temperature of the hot gas intake by controlling a percentage content of flammable gas includes:

opening valves providing said flammable gas to said hot gas intake when said measured temperature is below a predetermined minimum; and closing said valves providing said flammable gas to said hot gas intake when said measured temperature exceeds a predetermined maximum.

6. The method according to claim 5 wherein said using an indicator includes:

connecting said indicator with said valves providing flammable gas to said hot gas intake to provide an indication of moisture content of the granular material.

* * * * *